US007363893B2

(12) United States Patent
Rohe et al.

(10) Patent No.: US 7,363,893 B2
(45) **Date of Patent: *Apr. 29, 2008**

(54) SYSTEM FOR VARIABLE VALVETRAIN ACTUATION

(75) Inventors: Jeffrey D. Rohe, Caldeonia, NY (US); Richard B. Roe, Henrietta, NY (US); Jongmin Lee, Pittsford, NY (US); Jeffrey Gutterman, Hilton, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/294,223

(22) Filed: Dec. 5, 2005

(65) Prior Publication Data

US 2007/0125329 A1 Jun. 7, 2007

(51) Int. Cl.
*F01L 1/34* (2006.01)

(52) U.S. Cl. ..... 123/90.16; 123/90.15; 123/90.39

(58) Field of Classification Search ..... 123/90.16, 123/90.15, 90.39
See application file for complete search history.

(56) References Cited

U.S. PATENT DOCUMENTS

| | | | | |
|---|---|---|---|---|
| 5,791,306 | A * | 8/1998 | Williamson | 123/90.16 |
| 7,117,831 | B2 * | 10/2006 | Methley | 123/90.16 |
| 2003/0019448 | A1 * | 1/2003 | Aoyama et al. | 123/90.16 |

* cited by examiner

*Primary Examiner*—Zelalem Eshete
(74) *Attorney, Agent, or Firm*—Michael D. Smith

(57) ABSTRACT

An electromechanical VVA system for controlling the poppet valves in the cylinder head of an internal combustion engine. The system varies valve lift, duration, and phasing in a dependent manner for one or more banks of engine valves. A rocker subassembly for each valve or valve pair is pivotably disposed on a control shaft between the camshaft and the roller finger follower. The control shaft may be displaced about a pivot axis outside the control shaft to change the angular relationship of the rocker subassembly to the camshaft, thus changing the valve opening, closing, and lift. A plurality of control shafts for controlling all valvetrains in an engine bank defines a control shaft assembly. The angular positions of the individual control shafts may be tuned to optimize the valve timing of each cylinder. The system is applicable to the intake and exhaust camshafts of diesel and gasoline engines.

15 Claims, 18 Drawing Sheets

8
44
23
43
42
42

34
39
9
47
49
48
50
41
8
23
42
42
45
46

300
23
52
53
35
39
9
41
8
42
41
40
3
26
34

SYSTEM FOR VARIABLE VALVETRAIN ACTUATION

TECHNICAL FIELD

The present invention relates to valvetrains of internal combustion engines; more particularly, to devices for controlling the timing and lift of valves in such valvetrains; and most particularly, to a system for variable valvetrain actuation wherein electromechanical means for variable actuation is interposed between the engine camshaft and the valvetrain cam followers to vary the timing and amplitude of follower response to cam rotation.

BACKGROUND OF THE INVENTION

One of the drawbacks inhibiting the introduction of a gasoline Homogeneous Charge Compression Ignited (HCCI) engine in production has been the lack of a simple, cost effective and energy efficient Variable Valvetrain Actuation (VVA) system to vary both the exhaust and intake events. Many electro-hydraulic and electro-mechanical "camless" VVA systems have been proposed for gasoline HCCI engines, but while these systems may consume less or equivalent actuation power at low engine speeds, they typically require significantly more power than a conventional fixed-lift and fixed-duration valvetrain system to actuate at mid and upper engine speeds. Moreover, the cost of these "camless" systems usually is on par with the cost of an entire conventional engine itself.

As the cost of petroleum continues to rise from increased global demands and limited supplies, the fuel economy benefits of internal combustion engines will become a central issue in their design, manufacture, and use at the consumer level. In high volume production applications, applying a continuously variable valvetrain system to just the intake side of a gasoline engine can yield fuel economy benefits up to 10% on Federal Test Procedure—USA (FTP) or New European Driving Cycle (NEDC) driving schedules, based on simulations and vehicle testing. HCCI type combustion processes have promised to make the gasoline engine nearly as fuel efficient as a conventional, 4-stroke Diesel engine, yielding gains as high as 15% over conventional (non-VVA) gasoline engines for these same driving schedules. The HCCI engine could become strategically important to the United States and other countries dependent on a gasoline based transportation economy.

Likewise, the use of a continuously variable valvetrain for both the intake and exhaust sides of a Diesel engine has been identified as a potential means to reduce the size and cost of future exhaust aftertreatment systems and a way to restore the lost fuel economy that these systems presently impose. By varying the duration of intake lift events, potential Miller-cycle type fuel economy gains are feasible. Also, with VVA on the intake side, the effective compression ratio can be varied to provide a high ratio during startup and a lower ratio for peak fuel efficiency at highway cruise conditions. Without intake side VVA, compression ratios must be compromised in a tradeoff between these two extremes. Exhaust side VVA can improve the torque response of a Diesel engine. Varying exhaust valve opening times can permit faster transitions with the turbocharger, reducing turbo lag. Exhaust VVA can also be used to expand the range of engine operation where pulse turbo-charging can be effective. Furthermore, varying exhaust valve opening times can be used to raise exhaust temperatures under light load conditions, significantly improving NOx adsorber efficiencies.

VVA devices for controlling the poppet valves in the cylinder head of an internal combustion engine are well known.

For a first example, U.S. Pat. No. 5,937,809 discloses a Single Shaft Crank Rocker (SSCR) mechanism wherein an engine valve is driven by an oscillatable rocker cam that is actuated by a linkage driven by a rotary eccentric, preferably a rotary cam. The linkage is pivoted on a control member that is in turn pivotable about the axis of the rotary cam and angularly adjustable to vary the orientation of the rocker cam and thereby vary the valve lift and timing. The oscillatable cam is pivoted on the rotational axis of the rotary cam.

For a second example, U.S. Pat. No. 6,311,659 discloses a Desmodromic Cam Driven Variable Valve Timing (DCDVVT) mechanism that includes a control shaft and a rocker arm. A second end of the rocker arm is connected to the control shaft. The rocker arm carries a roller for engaging a cam lobe of an engine camshaft. A link arm is pivotally coupled at a first end thereof to the first end of the rocker arm. An output cam is pivotally coupled to the second end of the link arm, and engages a corresponding cam follower of the engine. A spring biases the roller into contact with the cam lobe and biases the output cam toward a starting angular orientation.

A shortcoming of these prior art VVA systems is that both the SSCR device and the DCDVVT mechanism include two individual frame structures per each engine cylinder that are somewhat difficult to manufacture.

Another shortcoming is that these mechanisms "hang" from the engine camshaft and thus create a parasitic load. The SSCR input rocker is connected through a link to two output cams that also ride on the input camshaft. Because the mechanism comprises four moving parts per cylinder, it is difficult to design a return spring stiff enough for high-speed engine operation that can still fit in the available packaging space.

Still another shortcoming is that assembly and large-scale manufacture of the SSCR device would be difficult at best with its high number of parts and required critical interfaces.

What is needed in the art is a simplified VVA mechanism that is not mounted on the engine camshaft, is easy to manufacture and assemble, and requires minimal packaging space in an engine envelope.

It is a principal object of the present invention to provide variable opening timing, closing timing, and lift amplitude in a bank of engine intake or exhaust valves.

It is a further object of the invention to simplify the manufacture and assembly of a VVA system for such variable opening, closing, and lift.

It is a still further object of the invention to provide such a system which is not parasitic on the engine camshaft.

SUMMARY OF THE INVENTION

Briefly described, the invention contained herein includes an electromechanical VVA system for controlling the poppet valves in the cylinder head of an internal combustion engine. The system varies valve lift, duration, and phasing in a dependent manner for one or more banks of engine valves. Using a single electrical rotary actuator per bank of valves to control the device, the valve lift events can be varied for either the exhaust or intake banks. The device comprises a hardened steel rocker subassembly for each valve or valve pair pivotably disposed on a control shaft between the engine camshaft and the engine roller finger follower. The control shaft itself may be displaced about a pivot axis outside the control shaft to change the angular relationship of the rocker subassembly to the camshaft, thus changing the valve opening, closing, and lift. A plurality of control shafts for controlling a plurality of valve trains for a plurality of cylinders in an engine bank may be assembled linearly to define a control crankshaft for all the valves in the engine bank. The angular positions of the control shafts for the plurality of cylinders may be tuned by mechanical means with respect to each other to optimize the valve timing of each cylinder in a cylinder bank. The valve actuation energy comes from a conventional mechanical camshaft that is driven by a belt or chain, as in the SSCR device disclosed in U.S. Pat. No. 5,937,809 device. An electrical, controlling actuator attached to the control shaft receives its energy from the engine's electrical system.

Compared to prior art devices, an important advantage of the present mechanism is its simplicity. The input and output oscillators of prior art mechanical, continuously variable valvetrain devices, such as the SSCR and the DCDVVT, have been combined into one moving part. Due to its inherent simplicity, the present invention differs significantly from the original SSCR device in its assembly procedure for mass production. With only one oscillating member, the present invention accrues significant cost, manufacturing and mechanical advantages over these previous designs. Further, a VVA device in accordance with the present invention does not "hang" from the camshaft, as was the case with these other mechanisms and therefore is not a parasitic load on the camshaft. Since the present invention has only one moving part, its total mass moment of inertia is much lower and, hence, spring design is less challenging. Because mechanically there are fewer parts, there are fewer degrees of freedom in the mechanism. This simplifies the task of design optimization to meet performance criteria, by substantially reducing the number of equations required to describe the motion of the present device. Further, a device in accordance with the invention requires approximately one-quarter the total number of parts as an equivalent SSCR device for a similar engine application. With its cost advantages and design flexibility, the present device can easily be applied to the intake camshaft of a gasoline engine for low cost applications, or to both the intake and exhaust camshafts of a diesel or a gasoline HCCI engine.

BRIEF DESCRIPTION OF THE DRAWINGS

The present invention will now be described, by way of example, with reference to the accompanying drawings, in which.

Corresponding reference characters indicate corresponding parts throughout the several views. The exemplification set out herein illustrates one preferred embodiment of the invention, in one form, and such exemplification is not to be construed as limiting the scope of the invention in any manner.

DESCRIPTION OF THE PREFERRED EMBODIMENTS

The benefits and advantages of a VVA system in accordance with the invention may be better appreciated by first considering a prior art engine valvetrain without VVA.

Figure 1B:
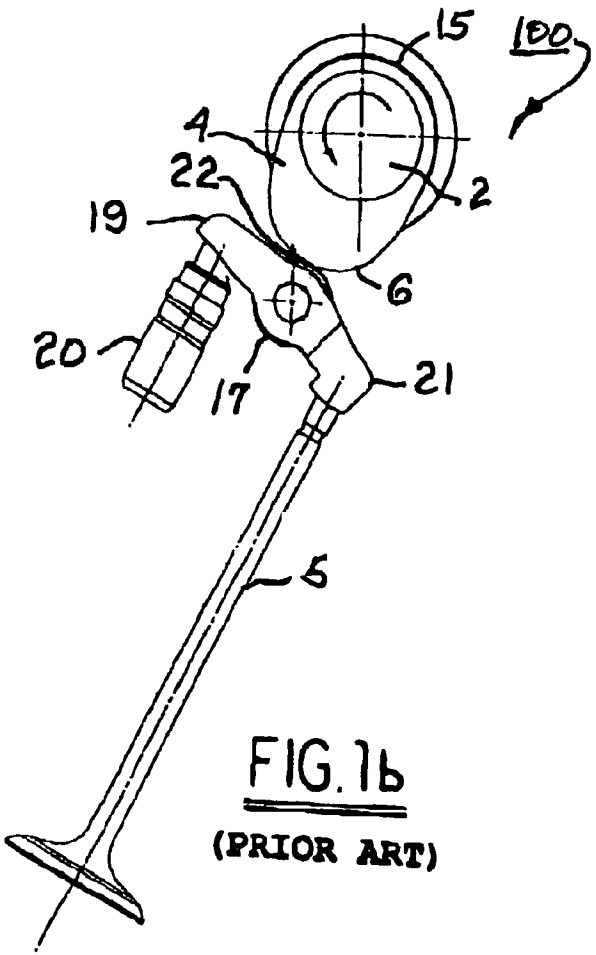
FIG. 1b (PRIOR ART)
FIG. 1*b* is a drawing like that shown in FIG. 1*a*, showing the valve in a fully open position.
Figure 1A:
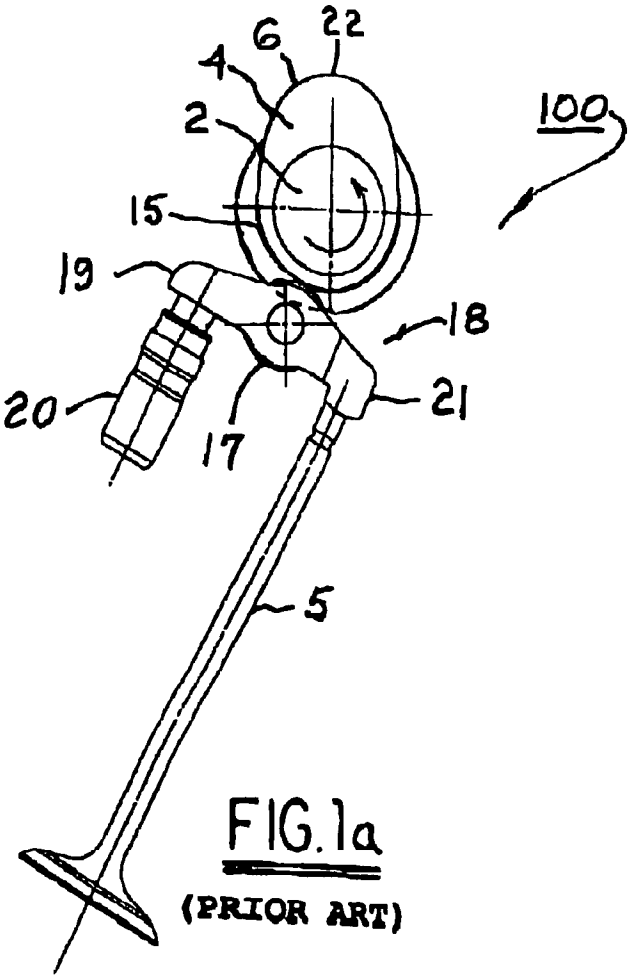
FIG. 1a (PRIOR ART)
FIG. 1*a* is an elevational drawing of a prior art valvetrain without VVA, showing the valve in the fully closed position.

Referring to FIGS. 1*a* and 1*b*, a prior art valvetrain 100 comprises an input engine camshaft 2 having a cam lobe 4. Lobe 4 is defined by a profile having a base circle portion 15, an opening flank 6, and a nose portion 22. A roller finger follower (RFF) 18 includes a centrally mounted roller 17 for following cam lobe 4 and is pivotably mounted at a first socket end 19 on a hydraulic lash adjuster 20. A second pallet end 21 of RFF 18 engages the stem end of an engine valve 5. When RFF 18 is on the base circle portion 15, valve 5 is closed, as shown in FIG. 1. As camshaft 2 rotates counterclockwise, RFF 18 begins to climb opening flank 6, forcing valve 5 to begin opening. When RFF 18 reaches nose portion 22, valve 5 is fully open, as shown in FIG. 2. Further rotation of camshaft 2 causes valve 5 to gradually close as RFF 18 moves down the closing flank of the cam lobe and returns to base circle portion 15. Note that in prior art valvetrain 100, the valve opening and closing timing and the height of valve lift are fixed by the cam lobe profile and are invariant.

Referring now to FIGS. 2*a*-11, an improved VVA valvetrain system 200 in accordance with the invention includes a control shaft assembly 1 shown at the intake valve camshaft 2 of an inline 4-cylinder engine 102 which may be spark-ignited or compression-ignited. In the present exemplary arrangement, the valvetrains include two intake valves per cylinder.

Figure 2A:
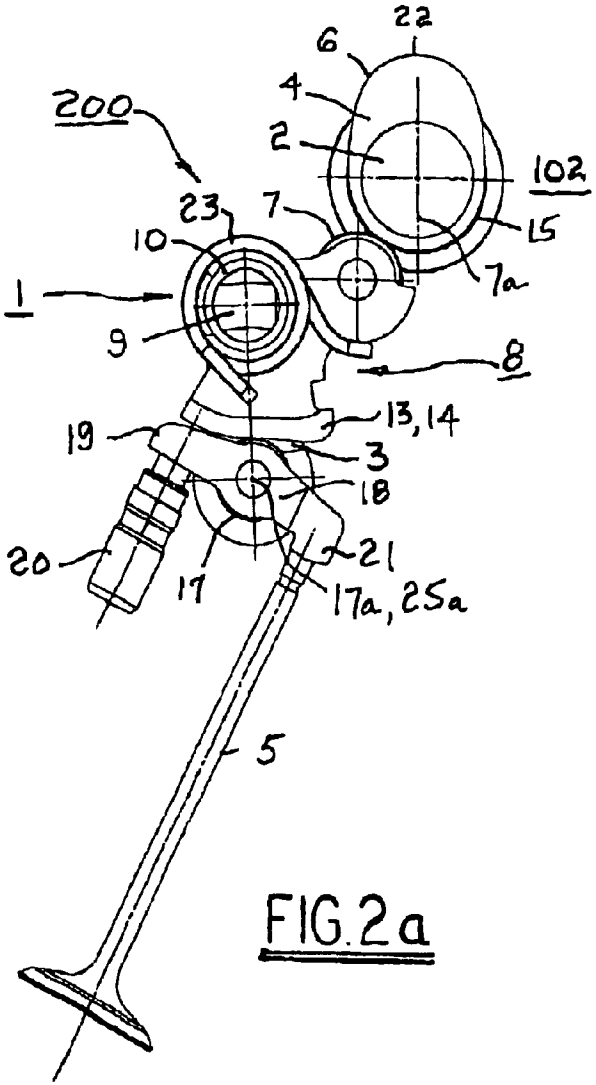
FIG. 2*a* is an elevational drawing of an improved valvetrain equipped with VVA means in accordance with the invention, showing the VVA in maximum lift position and the valve in the fully closed position.
Figure 2B:
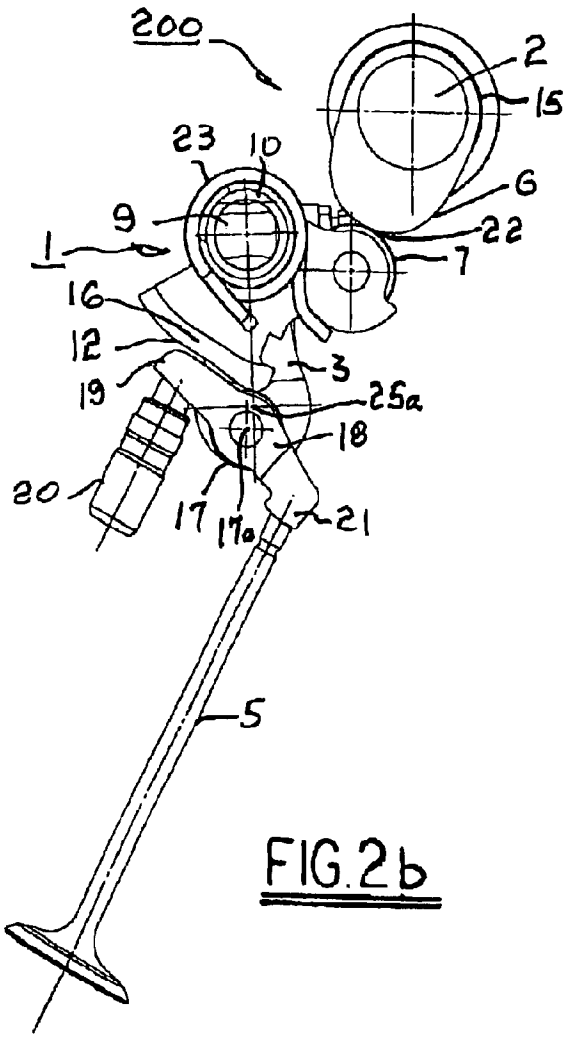
FIG. 2*b* is a drawing like that shown in FIG. 2*a*, showing the VVA in maximum lift position and the valve in the fully open position.

Control shaft assembly 1 manages an engine's gas exchange process by varying the angular position of its control shaft 1*a*. In FIGS. 2*a* and 2*b*, system 200 is shown in its full engine load position, and in FIGS. 3*a* and 3*b*, system 200 is shown in its lowest engine load position. In FIGS. 2*a*,3*a*, a view of system 200 with the input camshaft on its base circle appears, and in FIGS. 2*b*,3*b* a view with the input camshaft at its peak lift point appears. Note that actuator control shaft segment 38 has been removed for clarity in FIGS. 2 and 3.

As shown in FIGS. 2*a*,2*b*, high lift events with full duration are produced by the system whenever the control shaft arms 3 are in the nearly vertical position indicated. (For convenience in the following discussion, such terms as vertical, horizontal, above, and below are used in the sense as the elements appear in the figures; of course, it will be recognized that in an actual installation the directional relationships among the elements may be different.)

Figure 4:
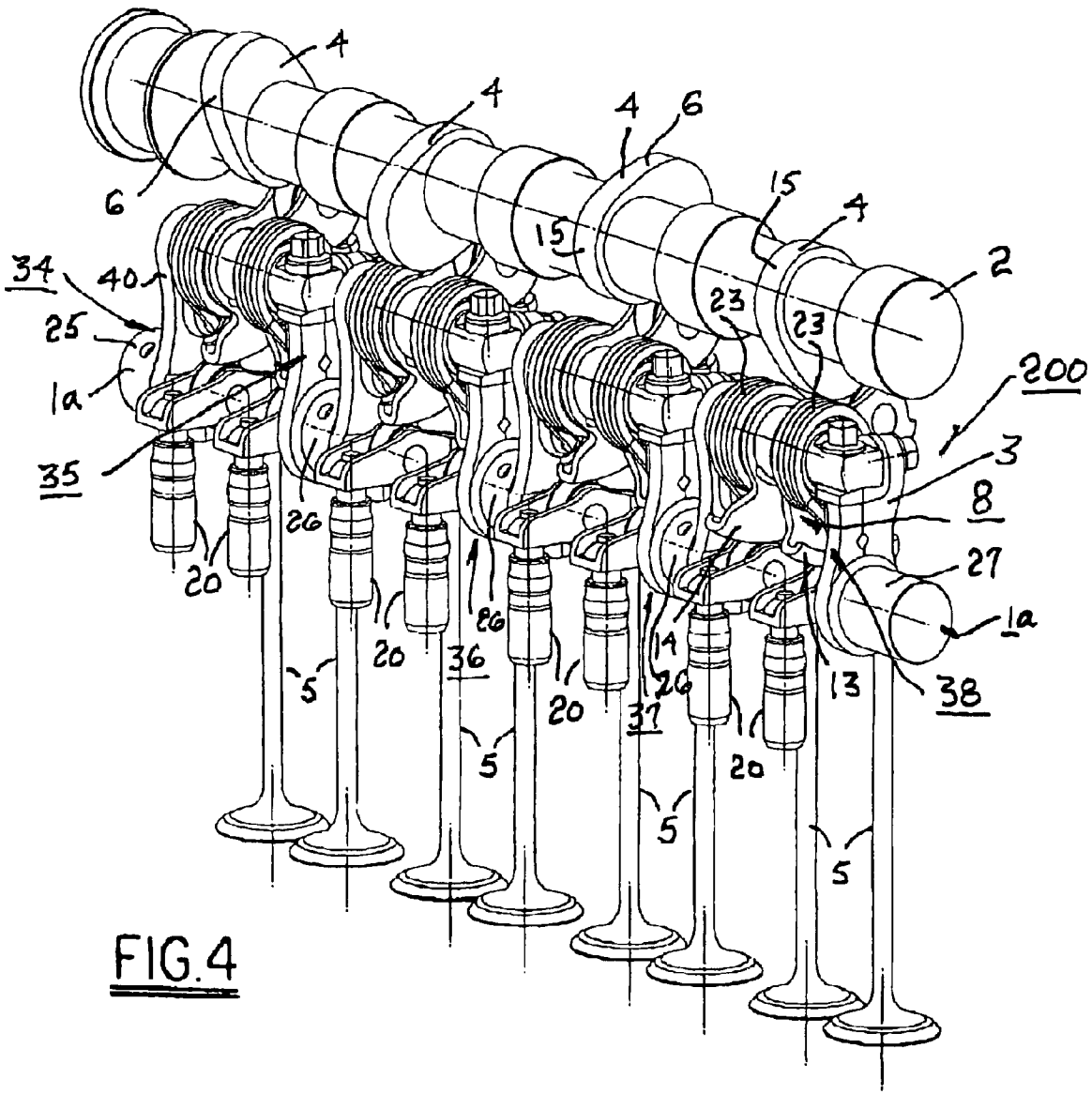
FIG. 4 is an isometric drawing of four valvetrains for a four-cylinder engine bank, the valvetrains being equipped with VVA means linked together in accordance with the invention.

As seen in FIG. 4, at each engine cylinder is a cam lobe 4, integral to a nodular cast iron input camshaft 2, centered axially between two engine valves 5. As input camshaft 2 rotates counter-clockwise, urged by an electromechanical rotary actuator (not shown) attached to an end of system 1, opening flank 6 of cam lobe 4 pushes hardened steel rocker roller 7 down, causing the stamped steel rocker subassembly 8 to rotate in a clockwise direction. As rocker subassembly 8 rotates, it turns about a forged steel (or cast iron) control shaft rocker pivot pin 9 of the lift control shaft assembly 1, one of which is located at each of the engine's cylinders. A mating bronze (or babbit) pivot bearing insert 10 facilitates rotation of rocker subassembly 8. When in the full engine load mode of operation (FIGS. 2*a*,2*b*), the locus of motion of rocker roller 7 is left of the centerline 7*a* of the input camshaft 2. Clockwise rotation of rocker subassembly 8 advances the output cam profiles 12 ground onto the folded and carbonized rocker flanges 13,14 to where the radius of output cam 16 increases beyond that of the base circle portion 15 of the cam profile. The further that rocker subassembly 8 is rotated about control shaft rocker pivot pin 9, the greater the lift imparted through finger follower rollers 17. The left end of each finger follower 18 pivots about the ball shaped tip of a conventional hydraulic valve lash adjuster 20. Pushing down on the centrally located finger follower roller 17 imparts lift to engine valve 5 via pallet 21 on RFF 18.

An important aspect and benefit of an improved VVA system in accordance with the invention is that no changes except relative location are required in the existing prior art camshaft, cam lobes, roller finger followers, hydraulic valve lifters, and valves. The only structural requirement in the engine is that the camshaft be removed farther from the HLA and RFF and offset slightly to permit insertion of VVA assembly 200 there between.

When control shaft assembly 1 is in the full lift position as shown in FIGS. 2*a*, 2*b*, maximum lift is reached at engine valves 5 whenever rocker roller 7 reaches nose portion 22 of input cam lobe 4. At this point, rocker subassembly 8 ceases to rotate in the clockwise direction. As input cam lobe 4 rotates further in the counter-clockwise direction, nose portion 22 of camshaft lobe 4 slips past rocker roller 7, and helical torsion return spring 23 forces rocker subassembly 8 to rotate counter-clockwise. This counter-clockwise rotation, in turn, reduces lift produced between the output cam profiles 12 and finger follower rollers 17. Eventually, as camshaft 2 continues to rotate counter-clockwise, rocker roller 7 reaches base circle portion 15 of input cam lobe 4. Here, lift remains at zero, until the next engine event occurs in that cylinder. The motion described above produces a peak lift profile (FIG. 5, curve 210), similar to that produced by prior art system 100 as shown in FIGS. 1*a*,1*b*, to maximize gas flow to the engine.

Short shank pins 25,27 in control shaft assembly 1 ride in matching holes (not shown), bored through the engine's camshaft bearing webs, integral to the cylinder head. An electromechanical actuator (also not shown) rotates control shaft assembly 1 about the center of these holes to vary engine load. Note that the centerlines 25*a* of the control shaft shank pins 25,27 coincide with the centerlines 17*a* of finger follower rollers 17.

Figure 3B:
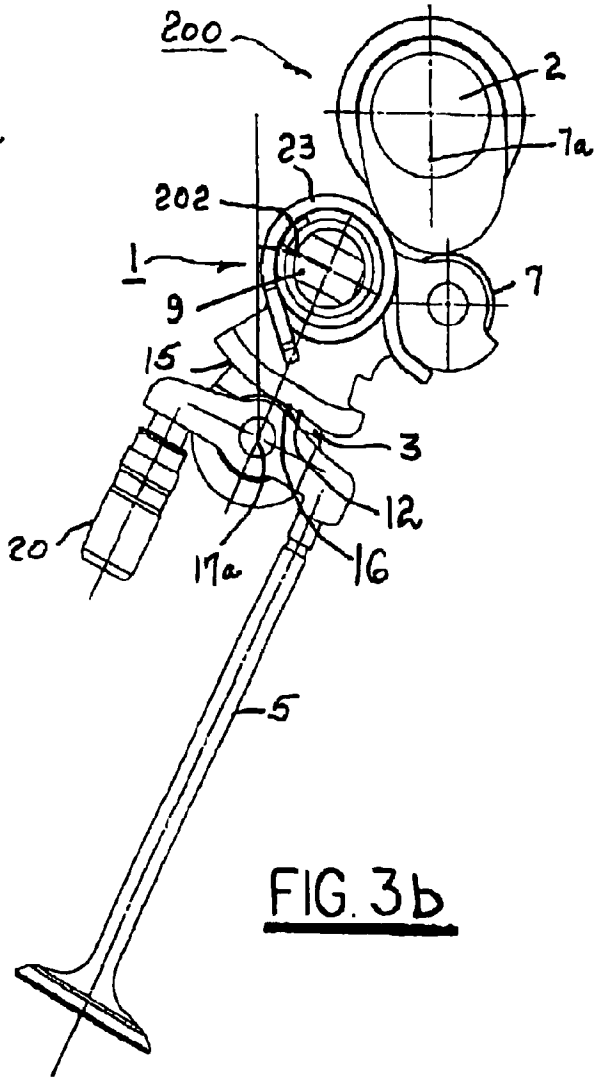
FIG. 3*b* drawing like that shown in FIG. 3*a*, showing the VVA in minimum lift position and the valve in the fully open position.
Figure 3A:
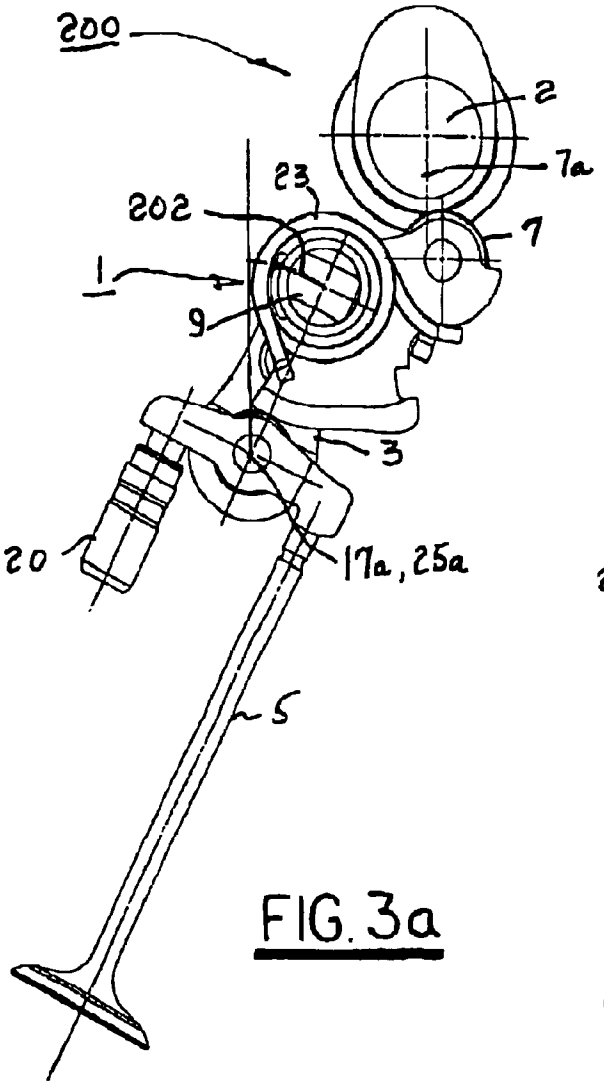
FIG. 3*a* is a drawing like that shown in FIG. 2*a*, showing the VVA in minimum lift position and the valve in the fully closed position.
Figure 5:
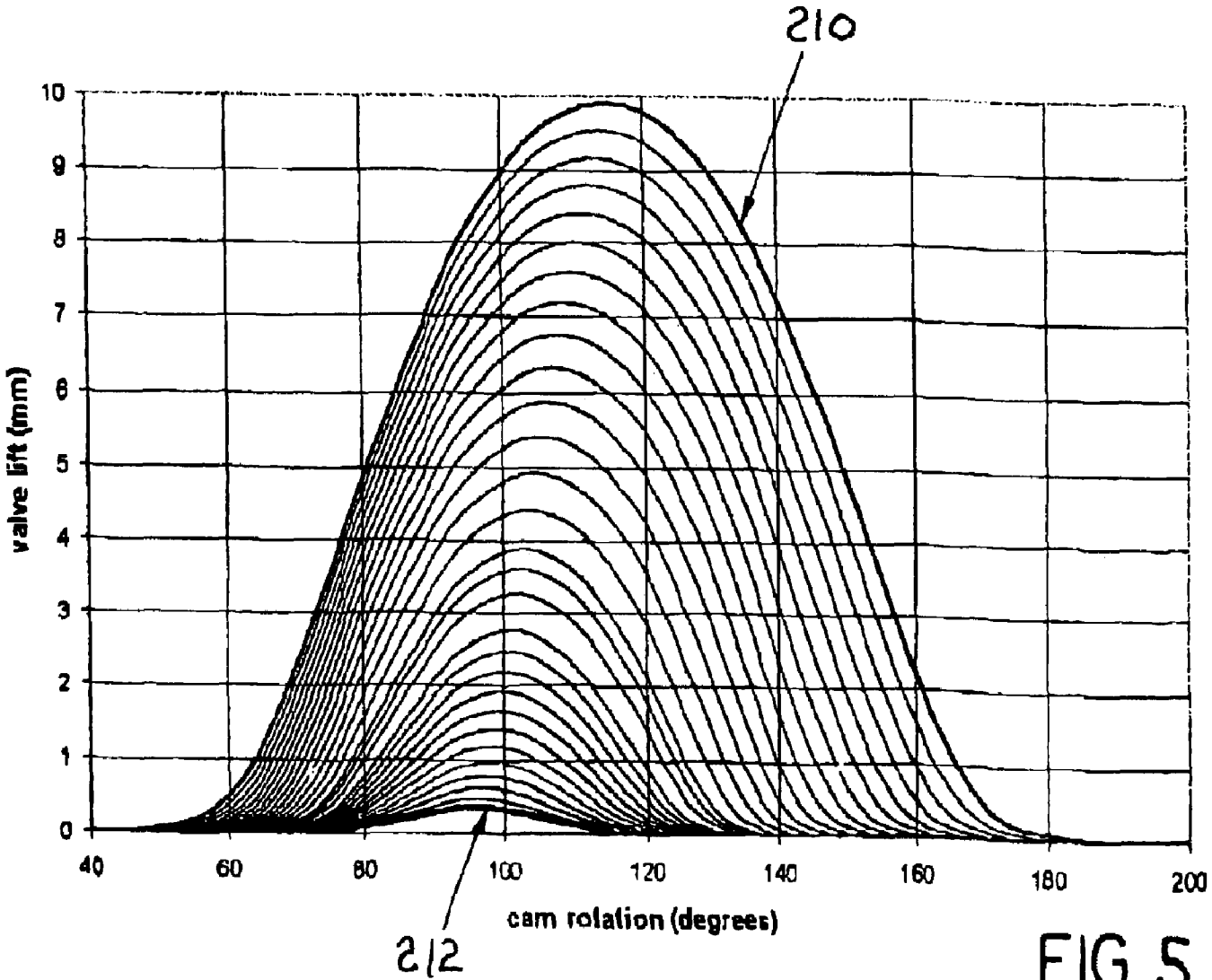
FIG. 5 is a graph showing a family of lift curves for a valvetrain equipped with VVA means in accordance with the invention, the curves being bounded by maximum lift of the apparatus shown in FIGS. 2*a* and 2*b*, and by minimum lift of the apparatus shown in FIGS. 3*a* and 3*b;*
Figure 6B:
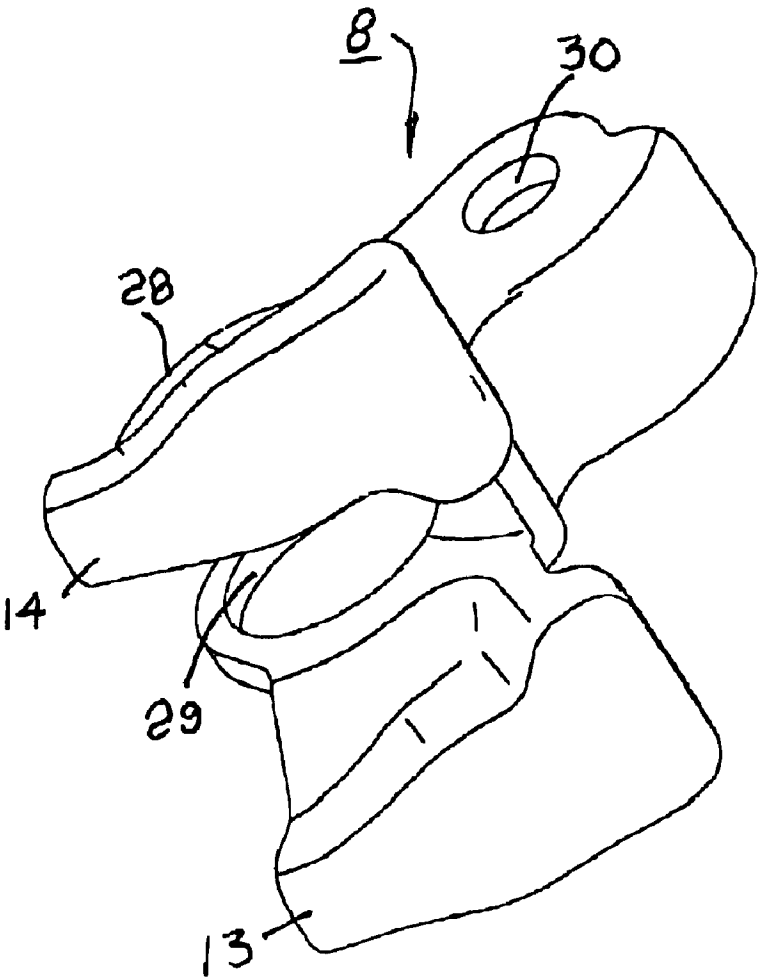
FIGS. 6*a* and 6*b* are isometric views from above and below, respectively, of a metal stamping for forming a VVA rocker frame in accordance with the invention.
Figure 6A:
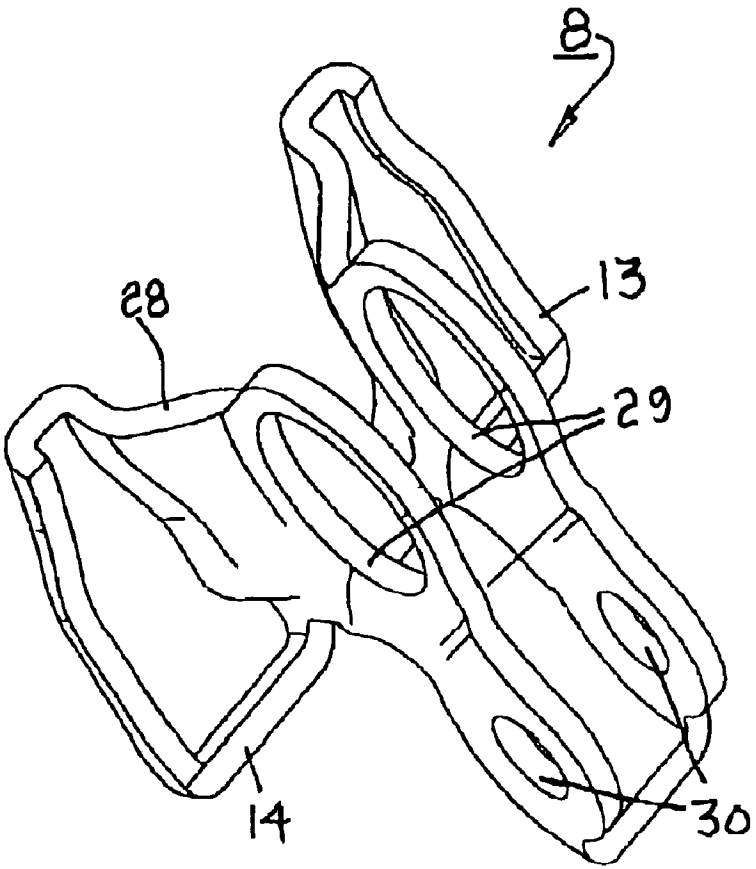
Figures 7A, 7B, 7C:
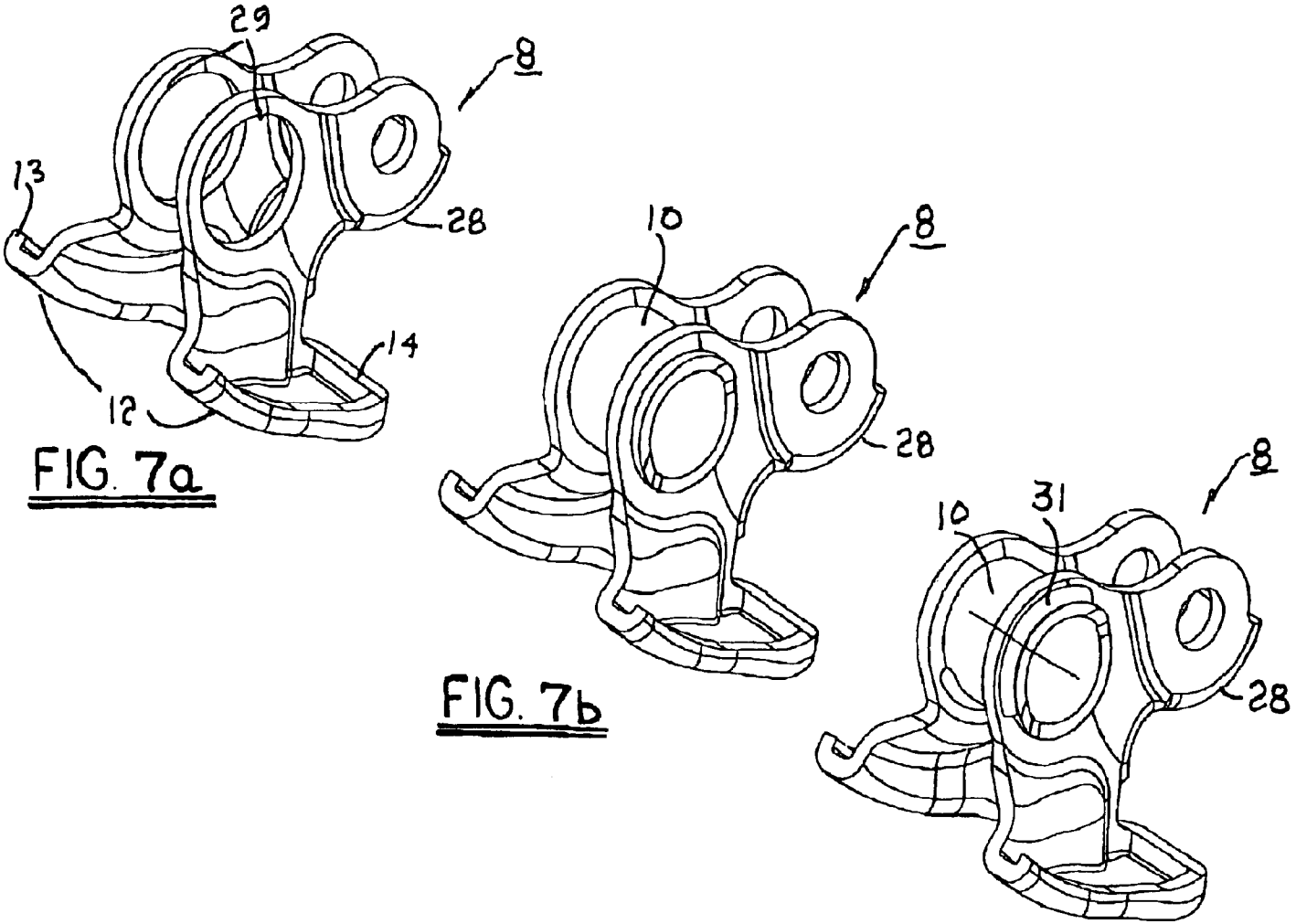
FIGS. 7*a*,7*b*,7*c*,8*a*,8*b*,8*c* are isometric views showing progressive steps in the manufacture and assembly of a VVA rocker in accordance with the invention.

Referring to FIGS. 3*a*,3*b*, if control shaft assembly 1 is rotated through an angle 202 clockwise on axis 17*a* from its full load position as shown in FIG. 2*a* (such as would be desirable under light engine load conditions), for example through about 27.5°, assembly 1 produces minimal lift events with reduced duration (also see curve 212 in FIG. 5). In this position (FIGS. 3*a*,3*b*), control shaft rocker pivot pins 9 are in their closest proximity to input camshaft 2, causing the loci of all rocker rollers 7 to oscillate just right of the centerline 7*a* of camshaft 2. Likewise, when control shaft assembly 1 is in the light load position, finger follower roller 17 spends most of its time on base circle portion 15 of output cam profile 12, just barely reaching opening flank 16 of the profile whenever rocker roller 7 is aligned with nose portion 22 of input camshaft lobe 4. Thus, assembly 1 produces short and shallow lift events (see FIG. 5, curve 212), which minimizes gas flow to the engine.

Variably rotating control shaft assembly 1 to intermediate rotational positions between full engine load position (FIGS. 2*a*,2*b*) and minimum engine load position (FIGS. 3*a*,3*b*) produces the remaining lift curves (not numbered) within the family depicted in FIG. 5 between curves 210,212.

Figures 8A, 8B, 8C:
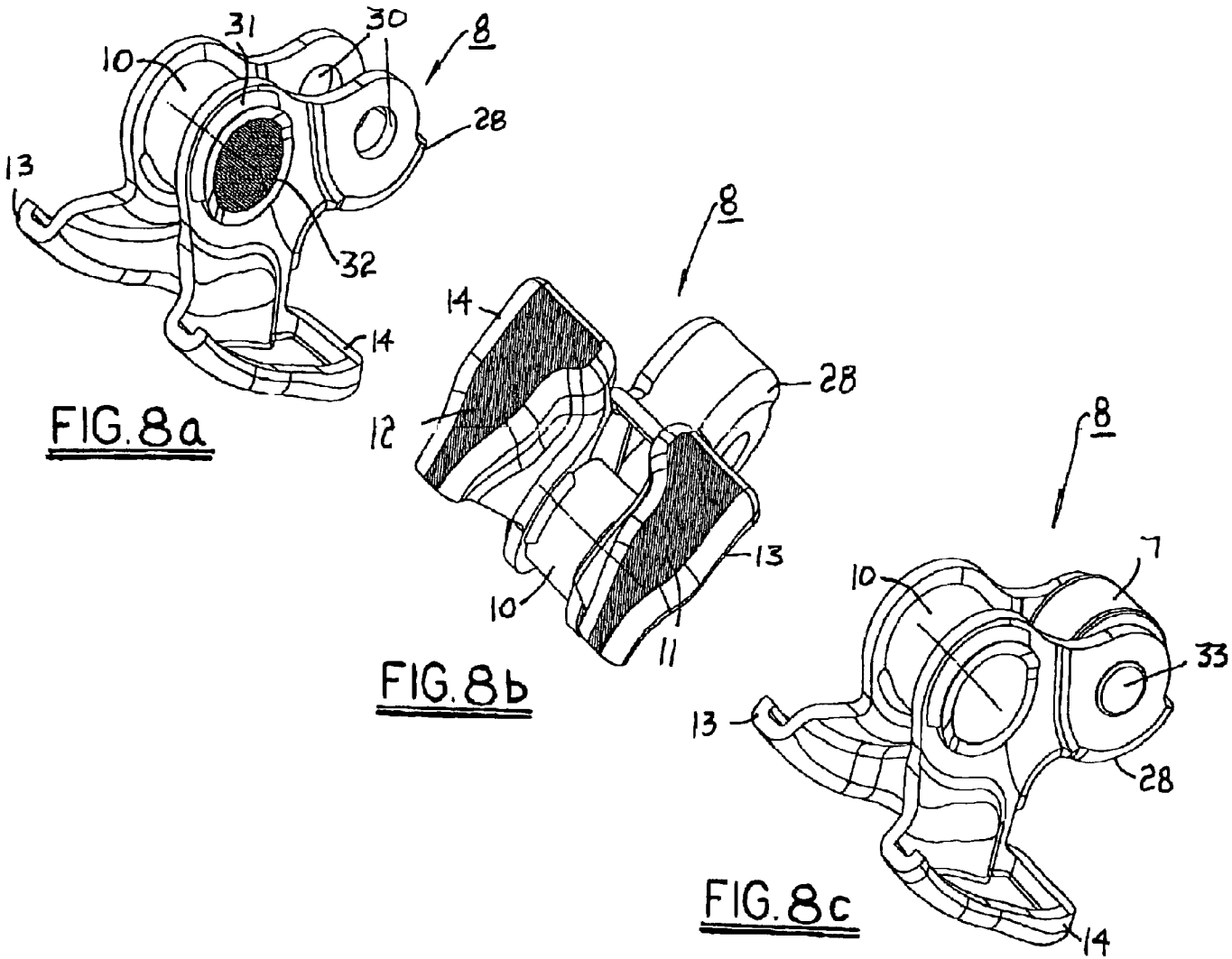

FIGS. 6*a* through 8*c* show sequential steps in formation of a stamped steel rocker subassembly 8. Each low carbon steel rocker frame 28 is stamped from sheet stock in a series of forming operations that may include punching in the rocker pivot bearing holes 29 and initial roller pin holes 30. Rocker flanges 13,14 are then carbonized to increase their hardness. Bronze pivot bearing insert 10 is then inserted into holes 29 and is held in place by assembly jigs (not shown) and fixed into permanent position in a copper brazing process 31. In the next step (FIG. 8*a*) of manufacture, bearing through-hole 32 for control shaft rocker pivot pin 9 and roller pin holes 30 are reamed to size and aligned with respect to the rocker flanges 13,14. The final cam profiles 11,12 are ground onto the lower surfaces of rocker flanges 13,14. A shaft spinning operation is employed to attach rocker roller 7, needle bearings (not shown), and retaining pin 33, providing a finished rocker sub-assembly 8 (FIG. 8*c*).

Engine cam 4 defines an input cam lobe to a valvetrain, and cam profiles 11,12 define a variable-output cam lobe of system 200 to RFF 18.

Referring now to FIG. 4 and FIGS. 9*a-c* and 10*a-b*, the control shaft assembly 1 of assembly 200 can be assembled from individual, segments 34,35,36,37,38, also referred to herein as control shaft sub-assemblies, to facilitate installation of the rocker sub-assemblies 8 and return springs 23. As noted above, when all the forged steel segments are assembled, control shaft 1 defines a control crankshaft for system 200. At three of the cylinder locations are modular unit-control shaft segments 35,36,37, each comprising a slender control shaft rocker pivot pin 9, a wider shoulder section 39, and a pair of control arms 3,40 that straddle a head shank pin 26. Control shaft assembly 1 is terminated at its ends by a drive end control shaft segment 34 and an actuator control shaft segment 38, each of which has only one control shaft arm 3 and 40, respectively. The drive end control shaft segment 34 also includes a control shaft rocker pivot pin 9 and a shoulder section 39. All of the control shaft segments 34-38 contain diamond shaped, broached holes 41 for retention of the grounded end hooks 42 of return springs 23.

Figures 9A, 9B, 9C:
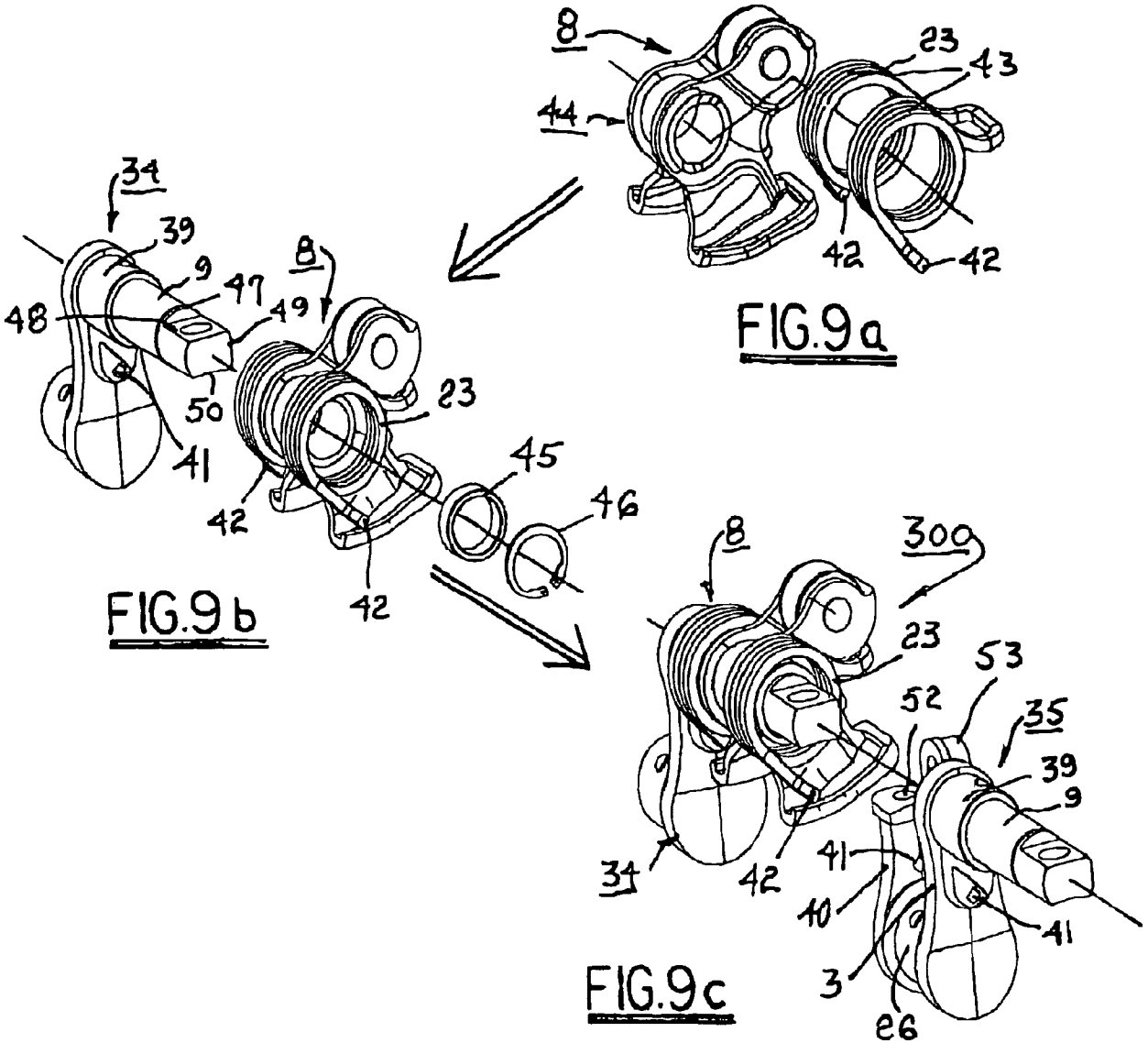
FIG. 9*a* is an exploded isometric view of a VVA rocker sub-assembly and return spring.
FIG. 9*b* is an exploded isometric view showing a first assembly of a VVA rocker sub-assembly and return spring onto a control shaft.
FIG. 9*c* is an exploded isometric view showing assembly of a second control shaft onto the first assembly shown in FIG. 9*b;*

Prior to the final assembly of system 200, the dual coils 43 of the helical, torsion return springs 23 are snapped in place over the closed middle section 44 and the pivot bearing insert 10 of each completed rocker sub-assembly 8 (see FIG. 9*a*). During assembly of a control shaft sub-assembly, the pivot bearing insert 10 of each rocker subassembly 8 and a hardened steel collar 45 are slid over the control shaft rocker pivot pin 9, while inserting one of the grounded end hooks 42 of each return spring into one of the broached holes 41 in the control shaft arms 3. The rocker subassembly 8 and steel collar 45 are retained axially against each shoulder section 39 by a common, external type snap ring 46 and a matching groove 47 in the circumference of each control shaft rocker pivot pin 9.

Figure 11:
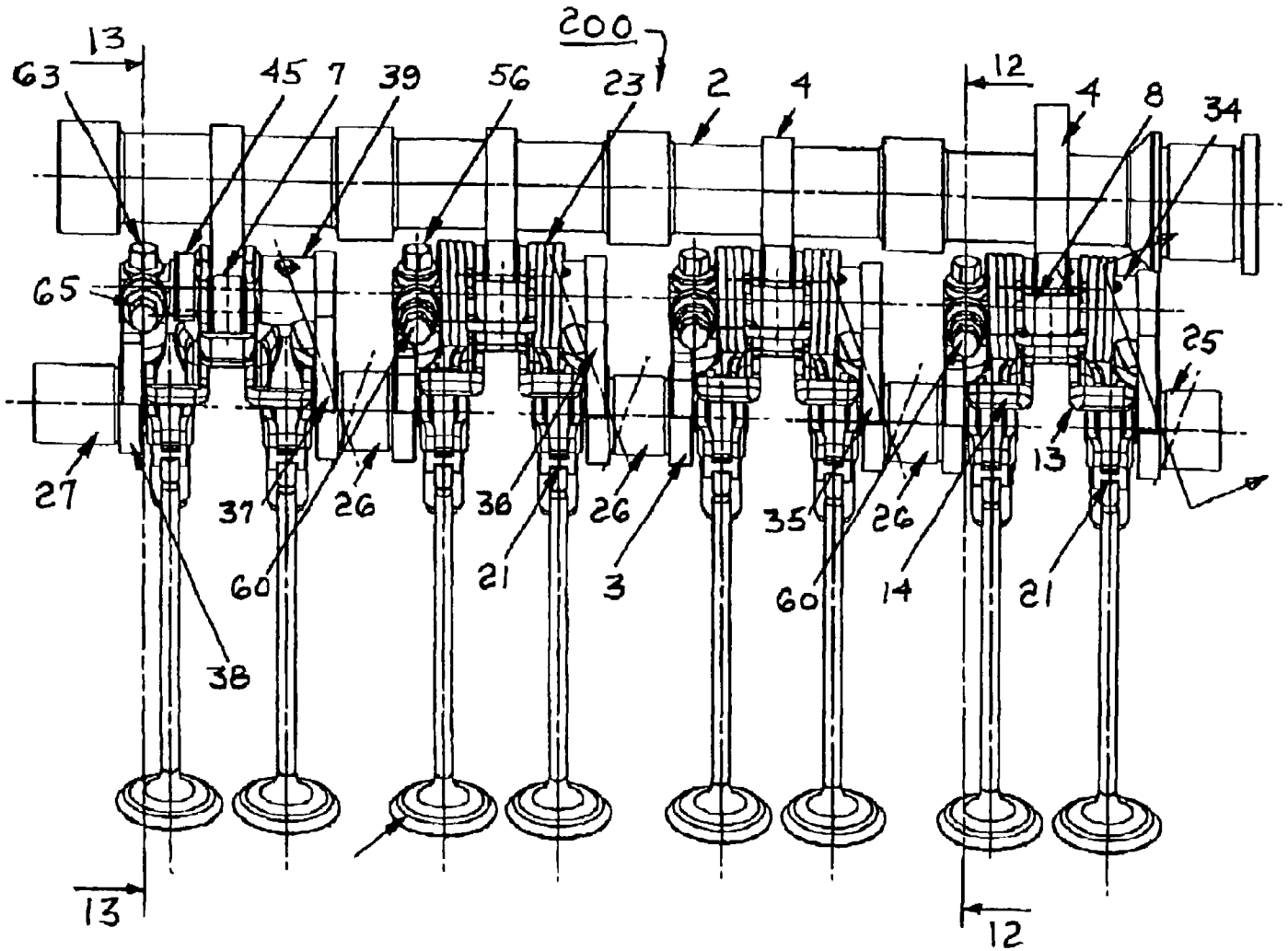
FIG. 11 is an elevational view of the valvetrains shown in FIG. 4.
Figure 13:
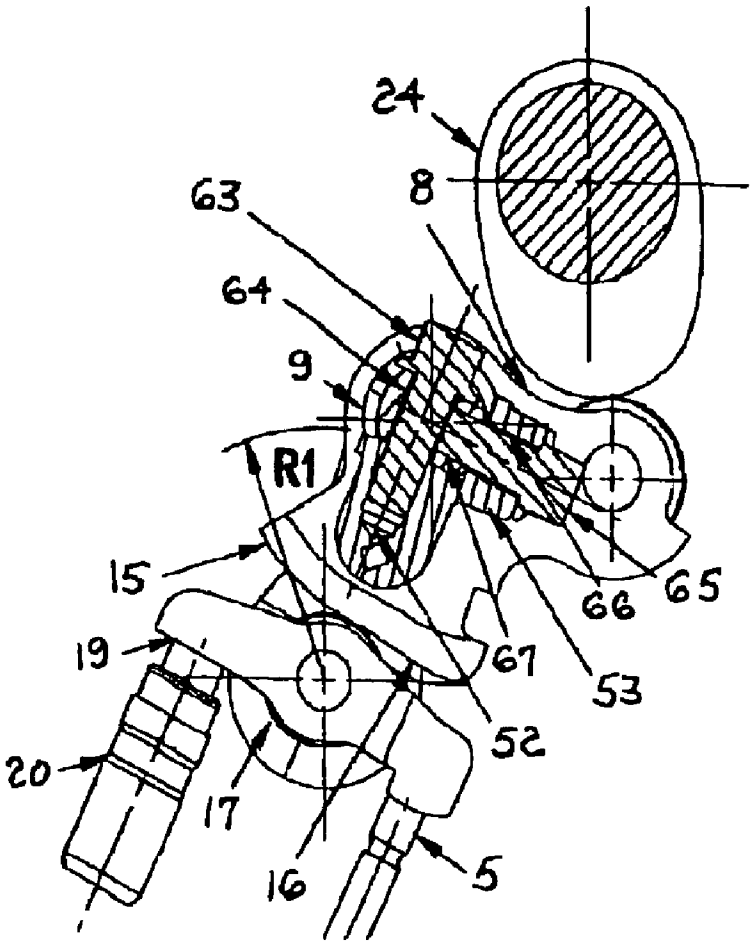
FIG. 13 is a cross-sectional view taken along line 13-13 in FIG. 11.
Figure 12:
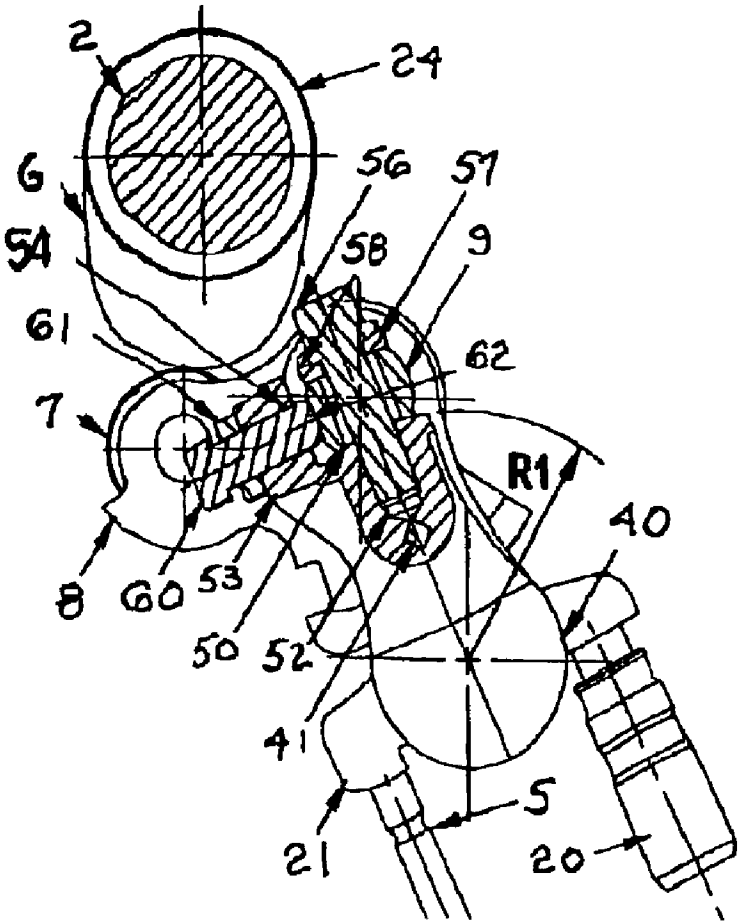
FIG. 12 is a cross-sectional view taken along line 12-12 in FIG. 11.

At the free end of each control shaft rocker pivot pin 9 are machined flats 48,49 and a cylindrically shaped arched pocket 50 of radius R1 (see FIGS. 12 and 13). Correspondingly, and referring now to FIGS. 10*a*,10*b*, at the opposite end of the unit-control shaft segments 35,36,37 and the actuator control shaft segment 38 is a notched control arm 40, complete with a mating arched flange 51 of radius R1, a blind, threaded hole 52 and an arm boss 53. Centered in the arm boss 53 of each unit-control shaft segment 35,36,37 is a threaded, adjustment hole 54. Also located in the free ends of the control shaft rocker pivot pins 9 for the drive end control shaft segment 34 and the first two unit-control shaft segments 35,36 are machined slots 55. These permit rigid yet adjustable connections (see FIGS. 10*b*, 11, and 14*a-d*) between adjacent control shaft segments 34-37 permit individually setting the valve lift at each cylinder.

Figure 10A:
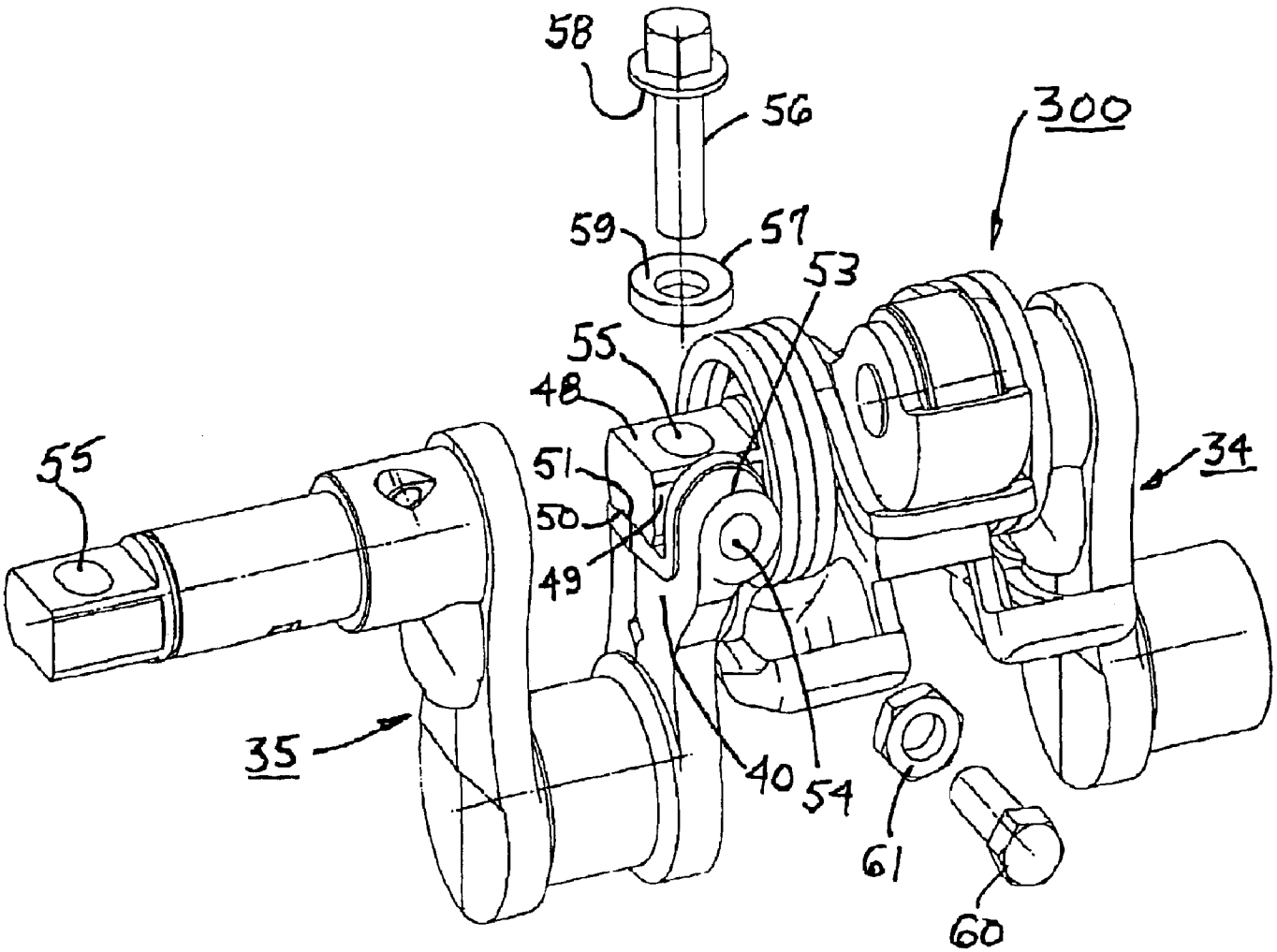
FIG. 10*a* is an exploded isometric view showing joining of the elements shown in FIG. 9*c;*
Figure 10B:
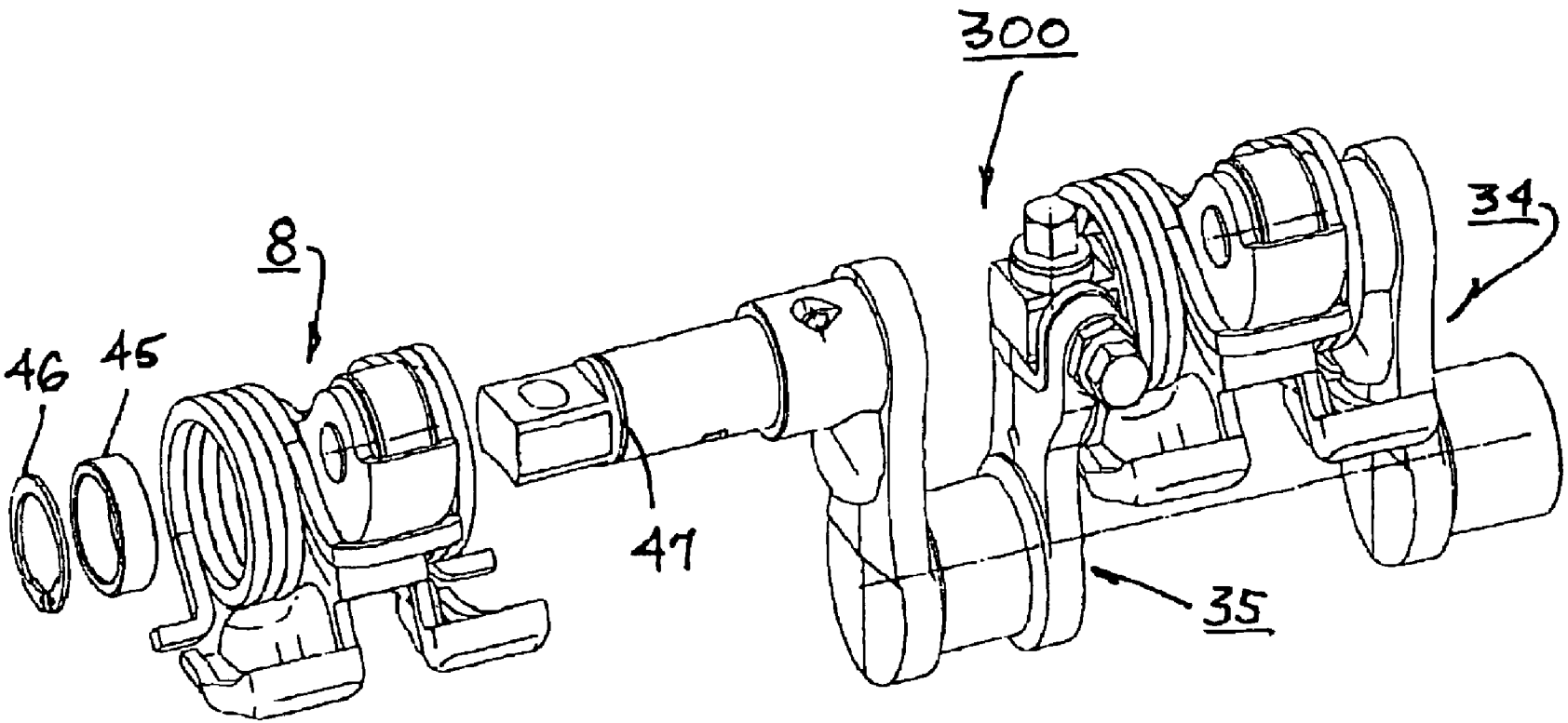
FIG. 10*b* is an exploded isometric view showing addition of a second VVA rocker sub-assembly onto the assembly shown in FIG. 10*a;*

The completed control shaft segment sub-assemblies 300 (FIG. 9*c*) are bolted together (see FIGS. 10*b* and 11). The arched flange 51 of the first unit-control shaft segment sub-assembly 300 is placed into the arched pocket 50 of the completed drive end control shaft segment 34. A special, flanged head, clamping cap screw 56 feeds through a shaped washer 57 and the machined slot 55 of the drive end control shaft segment 34, engaging the blind, threaded hole 52 in the notched control arm 40 of first unit-control shaft segment 35. On the lower side of the clamping cap screw 56 head is a convex, spherical surface 58 that mates with a concave, spherical socket 59 ground into the top of each shaped washer 57. These spherical surfaces (see FIG. 10*a*) accommodate the upper flat 48 of the drive end control shaft segment 34 as it tilts relative to the axis of the clamping cap screw 56, during cylinder-to-cylinder valve lift adjustments.

FIG. 12 details a cross-section at the first joint of control shaft rocker pivot pin 9 to the notched control arm 40. The hex head, adjuster cap screw 60 is threaded through a standard, thin series, hex head jam nut 61 and the threaded, adjustment hole 54 in the arm boss 53. This adjuster cap screw 60 includes a convex, spherical tip 62 that rests against the machined flat 49 on the side of the drive end control shaft segment 34. Whenever the flanged head, clamping cap screw 56 is loosened for cylinder-to-cylinder valve lift adjustments, clockwise rotation of the adjuster cap screw 60 causes the spherical tip 62 to push the machined side flat 49 of the drive end control shaft rocker pivot pin 9 away from the arm boss 53 of the first unit-control shaft segment 35, resulting in a slight angular shift between these adjacent control arm segments.

After lift adjustment, the clamping cap screw 56 and jam nut 61 are tightened to lock the control shaft rocker pivot pin 9 of the drive end control shaft segment 34 to the first unit-control shaft segment 35, and the adjuster cap screw 60 in its arm boss 53, respectively. Connections between the next two, control shaft rocker pivot pins 9 and notched control arms 40 are similar.

The cross-section in FIG. 13 illustrates the last connection of the control shaft rocker pivot pin 9 to a notched control arm 40 between the third unit-control shaft segment 37 and the actuator control shaft segment 38. Since this connection does not require valve lift adjustments, it is different from the others. Here, an ordinary, flanged head cap screw 63 passes through a round clearance hole 64 in the free end of the cylinder 4 control shaft rocker pivot pin 9 and anchors into the blind threaded hole 52 of the last notched control arm 40. This is followed up with a second short flanged head cap screw 65 that feeds through another clearance bolt hole 66 centered in the final arm boss 53 and engages a threaded hole 67 in the side flat 49 of the last control shaft rocker pivot pin 9.

A novel feature of a VVA system in accordance with the invention is that the control shaft assembly 1 is inherently biased toward the idle, or low load, position by the return springs 23. This can best be seen in FIGS. 2*a* and 2*b*. Regardless of control shaft 1 load position or cylinder number, each helical torsion return spring 23 is always forcing the rocker subassembly 8 to maintain vital contact between each rocker roller 7 and its cam lobe 4 on the input camshaft 2. Likewise, since return springs 23 are grounded through their end hooks 42 to the control shaft assembly 1, instead of into the cylinder head as in the prior art, they also tend to rotate the control shaft arms 3,40 in a clockwise direction relative to the locations of their line-bored shank pins 25,27 in the cylinder head. As a result, at low engine speeds where inertia forces are not a concern, the control shaft electromechanical actuator (not shown) needs only to provide torque at the actuator end shank pin 27 in the counterclockwise direction to maintain a desired valve lift.

System 200 utilizes this inherent control shaft biasing to facilitate minute valve lift adjustments that are required to equalize low engine speed, light load, cylinder-to-cylinder gas flows in gasoline or Diesel applications. FIGS. 14*a-d* convey a unique lift adjustment scheme that system 200 provides for such applications, as follows.

After a cylinder head has been assembled with system 200, the engine manufacturer has several options to balance the cylinder-to-cylinder gas flow. The system flow balancing scheme provides the engine manufacturer a unique flexibility to choose the best method to fit its needs. Gas flow can be adjusted either on an individual cylinder head in a flow chamber environment, or on a completed running engine.

Assembly line calibration can be carried out on an automated test stand, with either a precision air flow rate meter for calibrating individual completed cylinder heads or with a bench type combustion gas analyzer for calibrating fully assembled engines. For balancing individual cylinder heads, lift can be adjusted either statically to match a desired steady-state, steady flow rate target with the camshaft fixed, or dynamically with the camshaft spinning, by measuring the time-averaged flow rate for each cylinder. However, system 200 can also be adjusted dynamically in a repair garage with a running engine, using cylinder-to-cylinder exhaust gas analysis techniques with a portable fuel/air ratio analyzer.

Figure 14A:
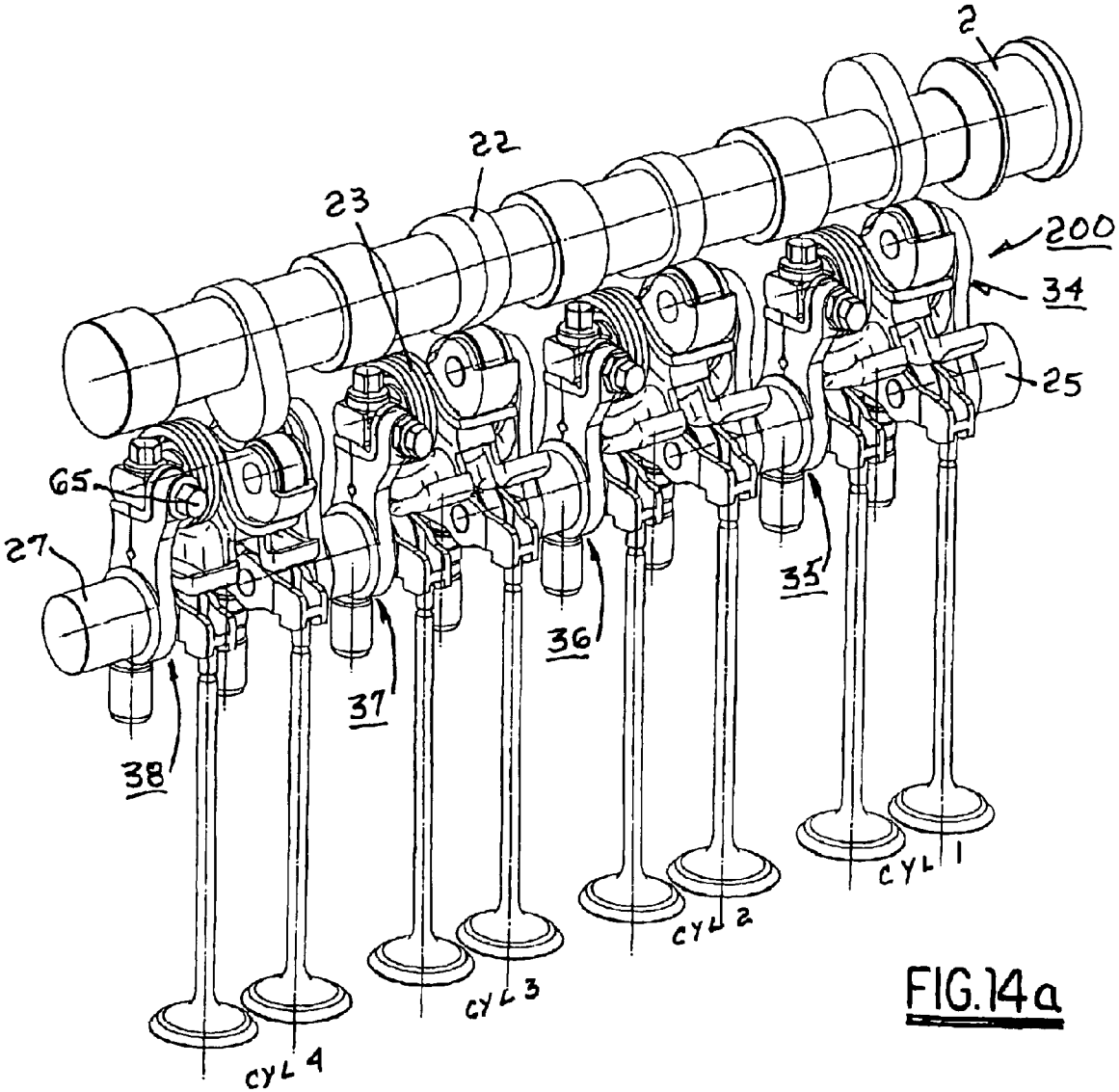
FIGS. 14*a* through 14*d* are isometric views like that shown in FIG. 4 but viewed from the opposite side, showing a sequence of air flow adjustment steps for tuning air flow to each individual engine cylinder.
Figure 14B:
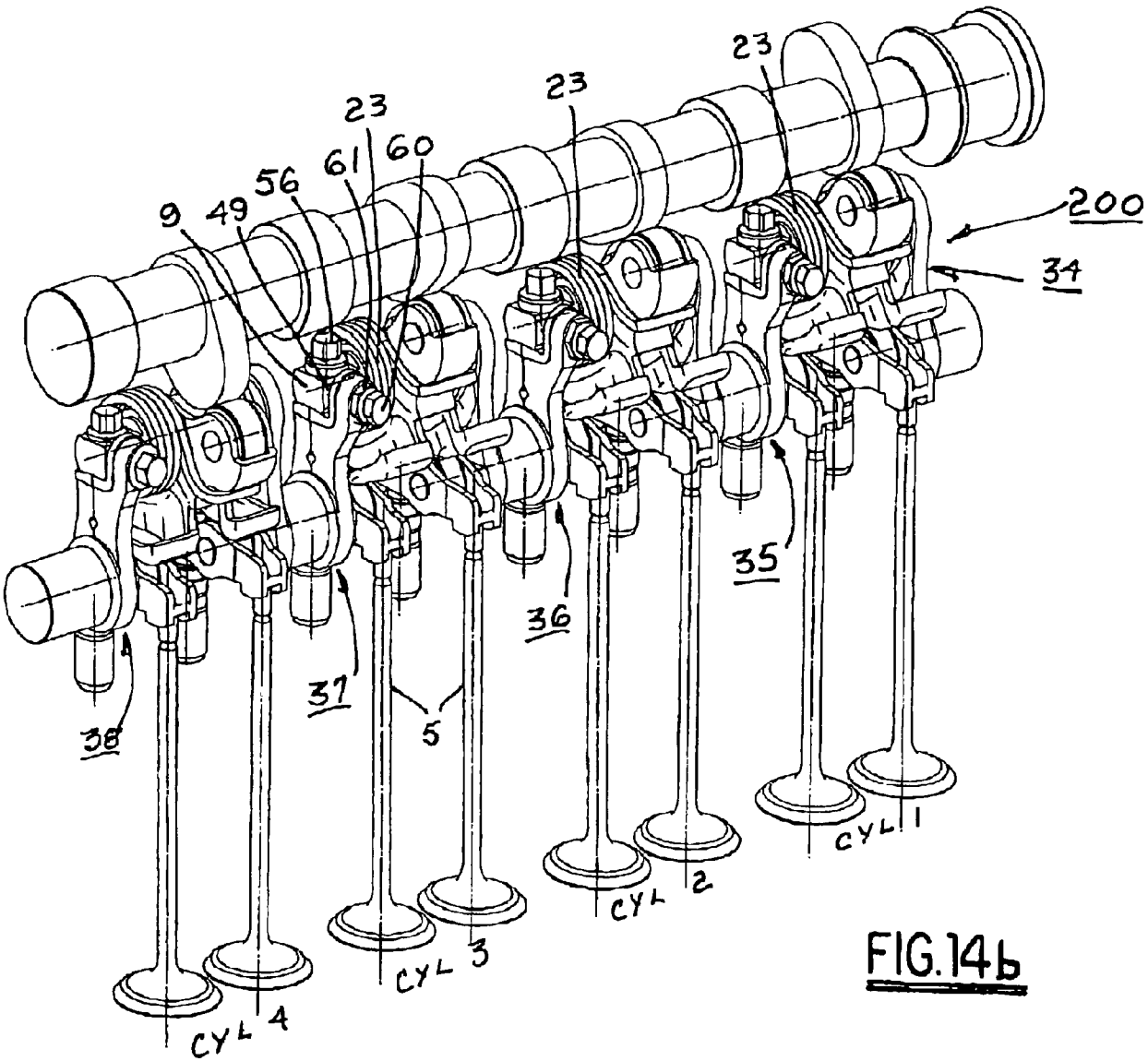
Figure 14C:
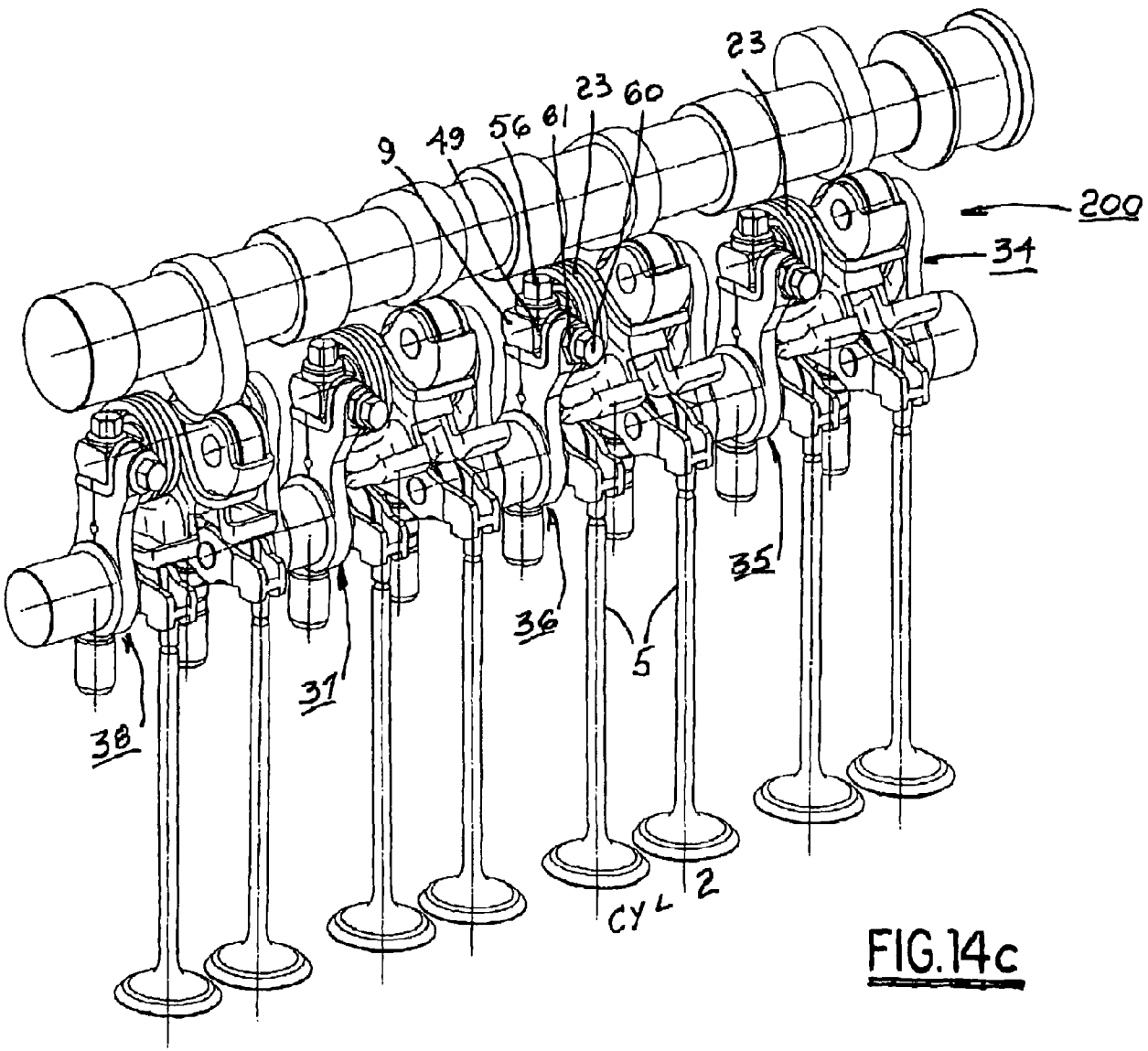
Figure 14D:
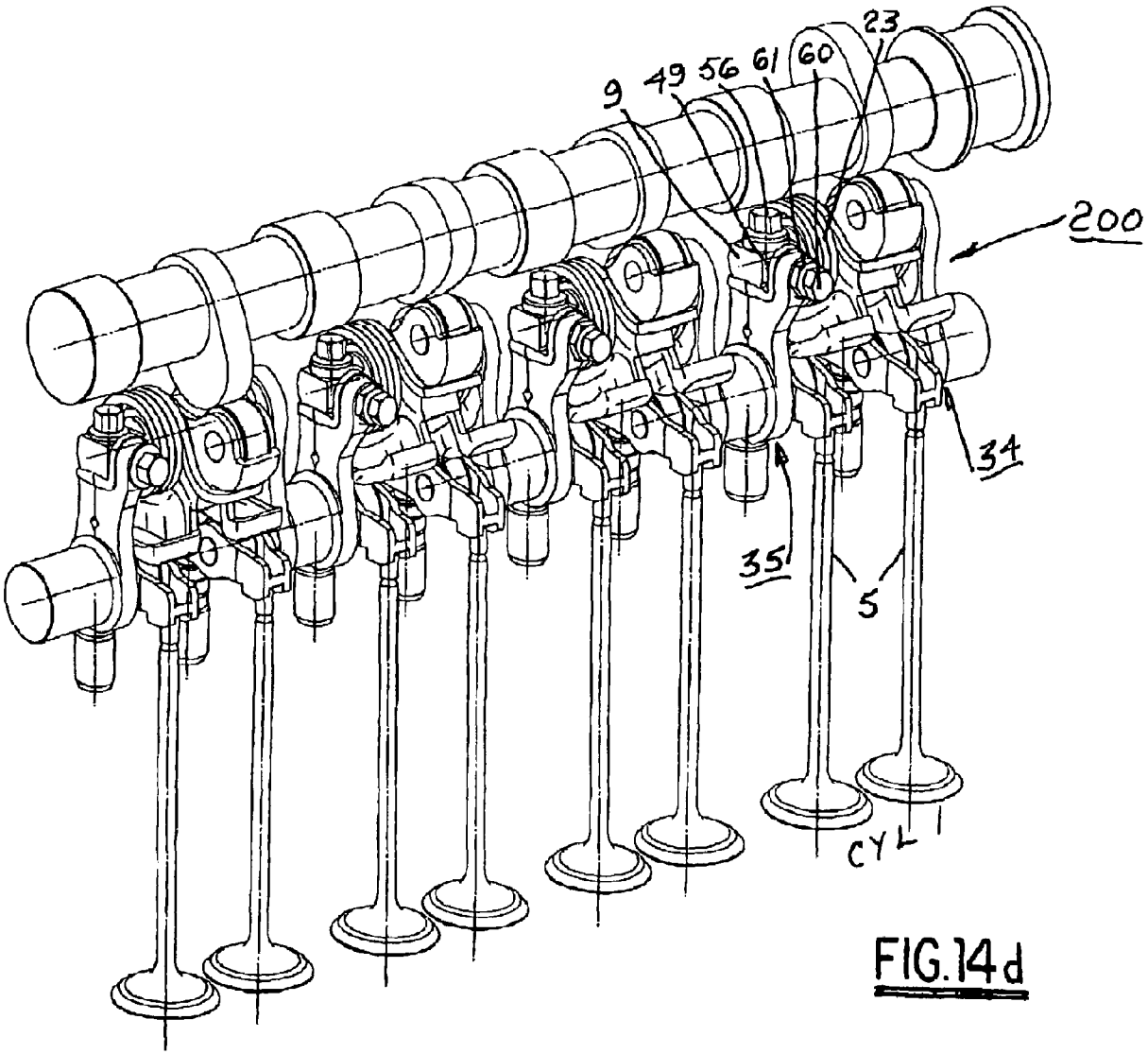

In the following adjustment procedure, it is assumed that a common, in-line 4 cylinder head (as shown in FIG. 4 or 14*a-d*) requires cylinder-to-cylinder intake air flow calibration. In either of the above scenarios, the balancing would start at cylinder 4 (FIG. 14*a*) and proceed sequentially down through cylinder 1 (FIG. 14*d*). At cylinder 4, under closed-loop control, the actuator voltage is varied until the angular position of the entire control shaft assembly 1 causes either the airflow or the Fuel/Air (F/A) ratio at cylinder 4 to match a target value. Once the flow rate or F/A ratio falls within a desired bandwidth at cylinder 4, the actuator position is recorded through a system position sensor (not shown) and maintained steadily from that point on. Note that while adjusting cylinder 4, all five control shaft segments 34-38 will rotate together, and that the actuator effectively "sees" the combined holding torque for all four cylinders.

Next, at cylinder 3 (see FIG. 14*b*), the adjuster jam nut 61 at the adjuster cap screw 60 and the clamping cap screw 56 between cylinders 3 and 4 are loosened slightly. While maintaining the same actuator position previously identified at cylinder 4, the adjuster cap screw 60 between cylinders 3 and 4 is rotated either clockwise or counter-clockwise, as required, to adjust the intake valve 5 flow rate for cylinder 3. Rotating the adjuster cap screw 60 will cause the drive end control shaft segment 34 for cylinder 1 and the unit-control shaft segments 35,36 for cylinders 2 and 3 to rotate relative to the unit-control shaft segment 37 for cylinder 4 by pushing against the ground side flat 49 at the free end of the cylinder 3 control shaft rocker pivot pin 9 and the resistance presented by the return springs 23 for cylinders 1, 2 and 3. When cylinder 3's airflow or F/A ratio falls within the desired bandwidth for the target, the clamping cap screw 56 and adjuster jam nut 61 are tightened to lock in the cylinder 3 adjustment.

In a similar fashion, the above adjustment procedure is repeated at cylinders 2 and 1 (see FIGS. 14*c* and 14*d*, respectively), in that order, by first loosening the appropriate adjuster jam nut 61 and clamping cap screw 56, turning the adjuster cap screw 60 to meet the flow rate bandwidth and then, tightening the adjuster jam nut 61 and clamping cap screw 56.

The flow adjustment resolution of the system is fine enough to balance the cylinder-cylinder airflow at an engine idle condition. One revolution of the adjuster cap screw 60 produces approximately a 0.2 mm change in valve lift. Preferably, a total adjustment range of about ±0.3 mm is provided at each joint.

The beauty of this adjustment scheme is the way in which the control shaft assembly 1 continues to reflect the total torque applied by the return springs 23 at each cylinder, at all times during the adjustment procedure. In other words, the adjustment procedure inherently compensates for any natural twisting or deflection of the control shaft assembly 1 due to the load applied by the return springs 23.

After the adjustments are completed at cylinder 1, then the automated stand can check to see that all cylinders are meeting their targeted flows. If any cylinder is off the target, a portion or all of the procedure can be repeated.

Figure 15:
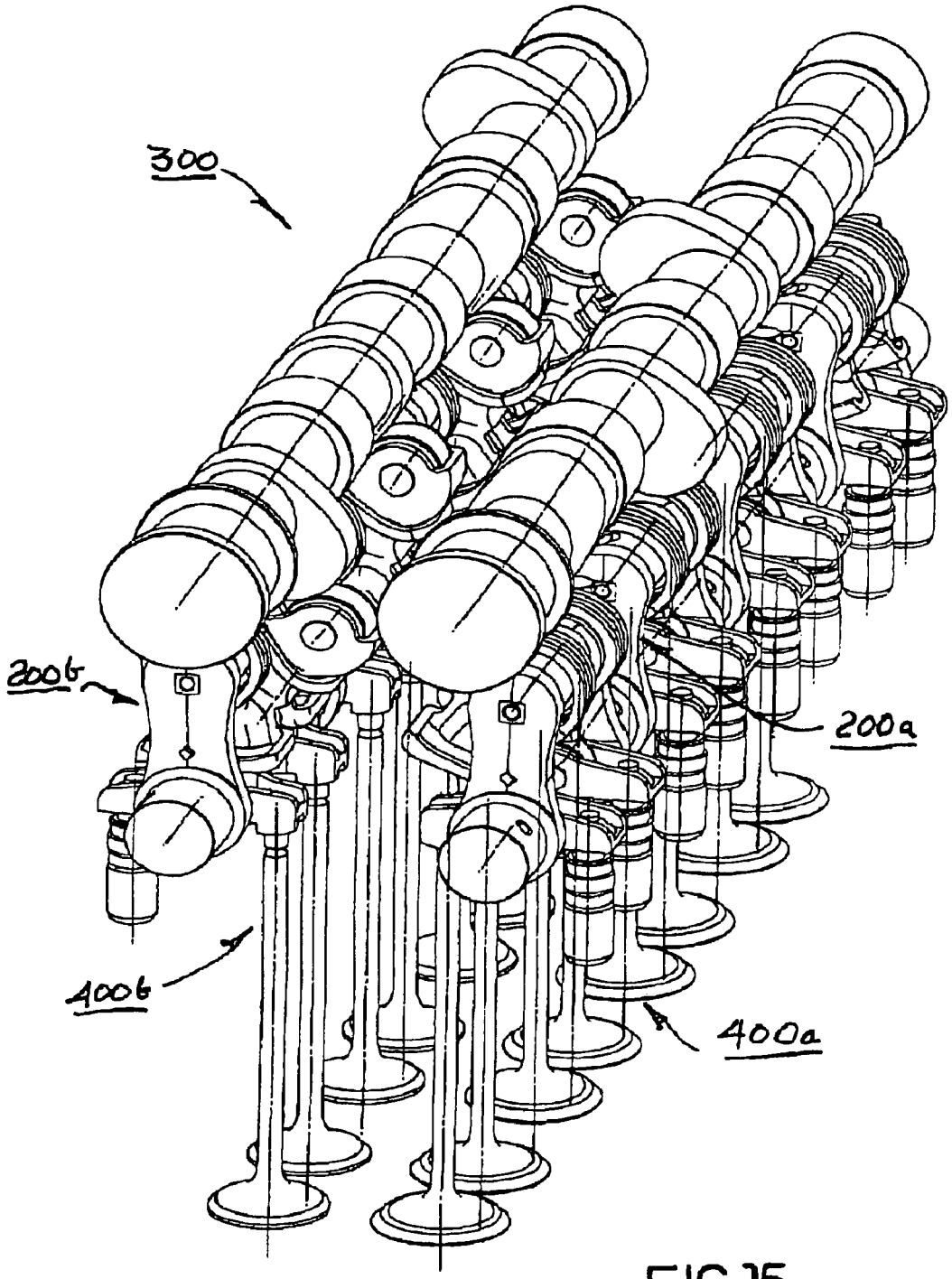
FIG. 15 is an isometric view showing VVA means in accordance with the invention installed on all of the intake valves and all of the exhaust valves of an inline four cylinder engine.

Referring now to FIG. 15, a complete improved valvetrain assembly 300 is shown for an inline bank of four cylinders having an intake camshaft and an exhaust camshaft, and having two intake valves and two intake roller finger followers for each cylinder, and having two exhaust valves and two exhaust roller finger followers for each cylinder, wherein a first VVA system 200*a* is incorporated in the intake valvetrain 400*a* and a second VVA system 200*b* in incorporated in the exhaust valvetrain 400*b*.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A variable valve actuation system for inclusion in an internal combustion engine between a camshaft and a plurality of roller finger followers to variably actuate a plurality of associated engine combustion valves to vary the timing of valve opening, timing of valve closing, and amplitude of valve lift, said system including at least sub-assembly comprising:

a) a pivot shaft having a first axis disposed parallel to an axis of rotation of said camshaft defined as a second axis;

b) a rocker sub-assembly pivotably disposed on said pivot shaft for rotation about said first axis, said rocker sub-assembly having a follower for following a lobe of said camshaft and having an output cam for engaging a one of said roller finger followers; and c) means for varying the distance of said pivot shaft axis from said camshaft axis to vary the action of said output cam upon said one of said roller finger followers to vary said timing and lift of an associated one of said valves, wherein said means for varying the distance includes means for rotating said pivot shaft about a third axis outside of said pivot shaft.

2. A system in accordance with claim 1 wherein said pivot shaft, said rocker sub-assembly, and said means for rotating together define a control shaft sub-assembly.

3. A system in accordance with claim 2 wherein said control shaft sub-assembly further comprises:

a) a control shaft segment wherein said third axis is the axis of said control shaft segment; and c) at least one control arm connected between said pivot shaft and said control shaft segment.

4. A system in accordance with claim 3 wherein said means for rotating further comprises an electromechanical rotary actuator operationally connected to said control shaft segment for rotating said pivot shaft, said control arm, and said control shaft segment about said third axis.

5. A system in accordance with claim 4 further comprising a bias spring disposed between said rocker sub-assembly and said control arm for maintaining contact of said roller with said cam lobe.

6. A system in accordance with claim 1 wherein said rocker sub-assembly further comprises:

a) a body;

b) a first orifice in said body for receiving said pivot shaft; and c) a second orifice in said body for receiving said follower.

7. A system in accordance with claim 3 further comprising a plurality of said control shaft subassemblies sequentially connected to define a control shaft assembly.

8. A system in accordance with claim 7, wherein said engine includes a plurality of cylinders, valves, cam lobes, and roller finger followers defining an inline bank of cylinders, and wherein a one of said plurality of control shaft sub-assemblies is associated with each of said plurality of cylinders.

9. A system in accordance with claim 7 further comprising:

a) a cylindrical pocket formed in a first of said adjacent segments; and b) a cylindrical surface formed in a second of said adjacent segments for mating with said cylindrical pocket;

wherein the respective radii of said cylindrical pocket and said cylindrical surface are identical and are centered on said third axis for adjusting the relative angular orientation between said adjacent of said segments.

10. A system in accordance with claim 9 further comprising an adjustment screw threadedly disposed in said second of said adjacent segments for bearing upon said first of said adjacent segments.

11. A variable valve actuation system for use in an internal combustion engine having a plurality of inline cylinders, the system being included between a camshaft and a plurality of roller finger followers for variably actuating a plurality of associated engine combustion valves to vary the timing of valve opening, timing of valve closing, and amplitude of valve lift, the system comprising a control shaft assembly including a plurality of joined-together control shaft sub-assemblies wherein each sub-assembly includes a pivot shaft having a first axis disposed parallel to an axis of rotation of said camshaft defined as a second axis, a rocker sub-assembly pivotably disposed on said pivot shaft for rotation about said first axis, said sub-assembly having a follower for following said cam lobe and having an output cam for engaging a one of said roller finger followers, and means for varying the distance of said pivot shaft axis from said camshaft axis to vary the action of said output cam upon said roller finger follower to vary the timing and lift of an associated engine valve, wherein a means for connecting adjacent control shaft sub-assemblies includes means for adjusting the relative angular orientation between said adjacent control shaft sub-assemblies.

12. A variable valve actuation system for inclusion in an internal combustion engine between a camshaft and a plurality of roller finger followers to variably actuate a plurality of associated engine combustion valves to vary the timing of valve opening, timing of valve closing, and amplitude of valve lift, said system including at least sub-assembly comprising:

a) a pivot shaft having a first axis disposed parallel to an axis of rotation of said camshaft defined as a second axis;

b) a rocker sub-assembly pivotably disposed on said pivot shaft for rotation about said first axis, said rocker sub-assembly having a follower for following a lobe of said camshaft and having an output cam for engaging a one of said roller finger followers; and c) a driven control shaft segment having a third axis, said driven control shaft segment for pivoting said pivot shaft and rocker sub-assembly about said third axis for varying the distance of said pivot shaft axis from said camshaft axis to vary the action of said output cam upon said one of said roller finger followers to vary said timing and lift of an associated one of said valves.

13. A system in accordance with claim 12 further including an actuator coupled with said control shaft segment for rotating said control shaft segment about said third axis and thereby pivoting said pivot shaft and rocker sub-assembly about said third axis.

14. A system in accordance with claim 12 wherein said third axis of said driven control shaft segment coincides with an axis of a roller coupled with said one of said roller finger followers.

15. A system in accordance with claim 12 further comprising at least one control arm connected between said pivot shaft and said control shaft segment.

* * * * *